US007985725B2

(12) United States Patent
Tippetts et al.

(10) Patent No.: US 7,985,725 B2
(45) Date of Patent: Jul. 26, 2011

(54) ULTRA CONCENTRATED LIQUID LAUNDRY DETERGENT

(75) Inventors: Denette M. Tippetts, Idaho Falls, ID (US); James L. Kurtz, Idaho Falls, ID (US); Earl David Brock, Idaho Falls, ID (US)

(73) Assignee: Melaleuca, Inc., Idaho Falls, ID (US)

( * ) Notice: Subject to any disclaimer, the term of this patent is extended or adjusted under 35 U.S.C. 154(b) by 70 days.

(21) Appl. No.: 12/541,232

(22) Filed: Aug. 14, 2009

(65) Prior Publication Data

US 2010/0041577 A1 Feb. 18, 2010

Related U.S. Application Data

(60) Provisional application No. 61/088,900, filed on Aug. 14, 2008.

(51) Int. Cl.
*C11D 17/00* (2006.01)

(52) U.S. Cl. ..... 510/421; 510/422; 510/424; 510/425; 510/426; 510/506

(58) Field of Classification Search ..... None
See application file for complete search history.

(56) References Cited

U.S. PATENT DOCUMENTS

| | | | | |
|---|---|---|---|---|
| 4,400,288 | A * | 8/1983 | Dhanani et al. | 510/347 |
| 5,075,026 | A | 12/1991 | Loth et al. | |
| 5,523,025 | A | 6/1996 | Erilli | |
| 5,604,195 | A | 2/1997 | Misselyn et al. | |
| 6,384,008 | B1 | 5/2002 | Parry | |
| 6,835,703 | B1 | 12/2004 | Cho et al. | |
| 2003/0100468 | A1 | 5/2003 | Smerznak et al. | |
| 2006/0178286 | A1 | 8/2006 | Hsu et al. | |
| 2006/0277953 | A1 | 12/2006 | Hsu et al. | |
| 2007/0287654 | A1 | 12/2007 | Hsu et al. | |
| 2009/0217462 | A1 | 9/2009 | Holzhauer et al. | |
| 2010/0016198 | A1 | 1/2010 | Bernhardt et al. | |
| 2010/0017969 | A1 | 1/2010 | Murphy et al. | |
| 2010/0093595 | A1 | 4/2010 | Holzhauer et al. | |

OTHER PUBLICATIONS

Authorized Officer Kwang Chul Kim, International Search Report in PCT/US2009/053811 mailed Mar. 9, 2010, 3 pages.

Authorized Officer Gijsbertus Beijer, International Preliminary Report on Patentability in PCT/US2009/053811 mailed Feb. 24, 2011, 5 pages.

* cited by examiner

*Primary Examiner* — Necholus Ogden, Jr.

(74) *Attorney, Agent, or Firm* — Fish & Richardson P.C.

(57) ABSTRACT

This disclosure relates to ultra concentrated liquid laundry detergent (e.g., 3×+ ultra concentrated liquid laundry detergent). For example, this disclosure relates to ultra concentrated liquid laundry detergent having superior water dispersibility at low temperatures (e.g., from about 14° C. to about 19° C.).

22 Claims, No Drawings

ULTRA CONCENTRATED LIQUID LAUNDRY DETERGENT

CLAIM OF PRIORITY

This application claims priority U.S. Provisional Application Ser. No. 61/088,900, filed on Aug. 14, 2008, the entire contents of which are hereby incorporated by reference.

BACKGROUND

1. Technical Field

This disclosure relates to ultra concentrated liquid laundry detergent (e.g., 3×+ ultra concentrated liquid laundry detergent). For example, this disclosure relates to ultra concentrated liquid laundry detergent having superior water dispersibility at low temperatures (e.g., from about 14° C. to about 19° C.).

2. Background Information

Laundry detergent is a substance which can be added when one is washing fabrics to help get the fabrics cleaner. Laundry detergent has traditionally been a powdered or granular solid, but the use of liquid laundry detergents has gradually increased over the years. One ingredient found in both types of detergents is a surfactant. A surfactant is a substance which, when added to water, significantly reduces the surface tension of the water, allowing the water to penetrate the fabric rather than slide off its surface. The result is that the water can function more effectively, acting to loosen the dirt from the clothing, and then hold it until it can be washed away. In addition to surfactants, a detergent may contain various additional components such as antiredeposition agents, corrosion inhibitors, fluorescent whitening agents, processing aids, colorants, fragrances, opacifiers, oxygen bleach, enzymes, fabric softening agents, chlorine scavengers, dye transfer inhibitors, malodor control agents, and suds control agents.

SUMMARY

This disclosure relates to ultra concentrated liquid laundry detergent. For example, this disclosure relates to ultra concentrated liquid laundry detergent having superior water dispersibility at low temperatures (e.g., from about 14° C. to about 19° C.).

Provided herein is an ultra concentrated liquid laundry detergent (UCLLD) composition including from about 25 to about 60% by weight of a nonionic surfactant; from about 5 to about 30% by weight of an anionic surfactant; from about 0.5 to about 18% by weight of a cold water dispersion aid; and from about 0 to about 60% by weight water. In some cases, the composition contains less than 1% by weight of a $C_{10-22}$ fatty acid.

A nonionic surfactant can include, without limitation, fatty alcohol ethoxylates; fatty acid ethoxylates; alkyl phenol ethoxylates; fatty monoglyceride ethoxylates; block copolymers; ethoxylated amines; alkyl amine oxides; mono or poly saccharide alkyl ethers; propoxylated and ethoxylated fatty alcohols; propoxylated and ethoxylated fatty acids; propoxylated and ethoxylated alkyl phenols; ether terminated ethoxylates of fatty acid and fatty alcohols; fatty acid glucamides; alkyl glucosides; alkyl polyglucosides; or mixtures thereof. In some cases, a fatty alcohol ethoxylate can be the condensation product of about 5 to about 10 moles of ethylene oxide per mole of alcohol.

An anionic surfactant can include, without limitation, alkylbenzene sulfonates; alkyl ether sulfates; alkyl sulfates; alkyl and alkenyl ester sulfonates; alkyl and alkenyl sulfonates; isethionates; taurates; or mixtures thereof Examples of alkyl ether sulfate salts include magnesium alkyl ether sulfate; sodium alkyl ether sulfate; triethanolamine alkyl ether sulfate; alkanolamine alkyl ether sulfate; and mixtures thereof. Examples of an alkylbenzene sulfonate include magnesium alkylbenzene sulfonate; sodium alkylbenzene sulfonate; triethanolamine alkylbenzene sulfonate; alkanolamine alkylbenzene sulfonate; and mixtures thereof In some cases, an alkanolamine alkylbenzene sulfonate is triethanolamine alkylbenzene sulfonate.

A cold water dispersion aid can include soluble alkali, alkaline earth and divalent metal salts; polyethylene glycols; poly-glycols; mono or polyhydric alcohols; water-miscible glycols; glycol ethers; hydrotropes; solvents of limited water solubility including without limitation benzyl alcohol; dipropylene glycol n-butyl ether; dipropylene glycol n-propyl ether; phenoxyethanol; and mixtures thereof.

In some cases, an UCLLD composition can also include one or more of a buffering agent, a detergent enzyme, an antiredeposition agent, a fragrance, a colorant, a fluorescent whitening agent, a corrosion inhibitor, an opacifier, an oxygen bleach, a fabric softening agent, a chlorine scavenger, a dye transfer inhibitor, a malodor control agent, a suds control agent, a chelating agent, and an adjuvant.

In certain cases, an UCLLD composition can contain from about 25 to about 60% by weight of a nonionic surfactant; from about 5 to about 30% by weight of an alkylbenzene sulfonate; from about 2 to about 12% by weight of propylene glycol; and from about 0.5% to about 6% by weight of magnesium sulfate heptahydrate. In other cases, an UCLLD composition can contain from about 30 to about 45% by weight of an ethoxylate of a fatty alcohol; from about 10 to about 25% by weight of a triethanolamine alkylbenzene sulfonate; from about 2.5 to about 10% by weight of propylene glycol; from about 1 to about 3% by weight of magnesium sulfate heptahydrate; and from about 0.1 to about 0.5% by weight of a stilbene fluorescent whitening agent.

In some cases, the composition can disperse in water from about 14° C. to about 19° C. in less than about 5 minutes.

In certain cases, the UCLLD composition can be a 3× ultra concentrated liquid laundry detergent; a 4× ultra concentrated liquid laundry detergent; a 5× ultra concentrated liquid laundry detergent; a 6× ultra concentrated liquid laundry detergent; or a 7× or higher ultra concentrated liquid laundry detergent.

Also provided herein is a method of cleaning fabrics in an automatic washing machine. The method can include dispensing an effective amount of an ultra concentrated liquid laundry detergent composition, as described above, into the machine. An effective amount of the liquid composition can range from about 0.1 fluid ounces per wash load to about 2 ounces per wash load. In some cases, the effective amount of the liquid composition ranges from about 0.5 fluid ounces per wash load to about 1 ounce per wash load. In certain cases, the liquid composition can disperse in water from about 14° C. to about 19° C. in less than about 5 minutes.

Unless defined otherwise, all technical and scientific terms used herein have the same meaning as is commonly understood by one of ordinary skill in the art to which this disclosure pertains. All patents, applications, published applications, and other publications are incorporated by reference in their entirety. In the event that there is a plurality of definitions for a term herein, those in this section prevail unless stated otherwise.

The details of one or more embodiments of the invention are set forth in the description below. Other features, objects, and advantages of the invention will be apparent from the description, and from the claims.

DETAILED DESCRIPTION

This disclosure relates to ultra concentrated liquid laundry detergent. More particularly, this disclosure relates to ultra concentrated liquid laundry detergent having superior water dispersibility at low temperatures.

This document provides an ultra concentrated liquid laundry detergent (UCLLD) composition including: (a) a nonionic surfactant; (b) an anionic surfactant; (c) a cold water dispersion aid; and (d) water.

As used herein a "ultra concentrated liquid laundry detergent" or "UCLLD" refers to a liquid detergent composition which contains at least about 45% by weight combined surface active agents such as nonionic surfactants, anionic surfactants, amphoteric surfactants and soaps and which is dosed at or less than about 1-fluid ounce per washload.

Many retail liquid laundry detergents have recommended dosages of 3- to 4-fluid ounces per washload. Such liquid laundry detergents can be termed 1× or normal concentrated liquid laundry detergents (NCLLD). Recently, some manufacturers have introduced products for which the recommended dosage has been reduced from 3- to 4-fluid ounces per washload to 1.5- to 2-fluid ounces per washload. Such products can be termed 2× concentrated liquid laundry detergent (CLLD). Liquid laundry detergents typically employ water as a principal solvent (e.g., greater than 50% by weight of the total composition). In some cases, other water-miscible solvents may be used to replace a portion of the water. While the amount of non-water ingredients in a 1× or NCLLD may vary, such a product typically contains a very predominant proportion of water.

For example, when converting from a 1× NCLLD to a 2× CLLD, the manufacturer can replace a portion of the water, the predominant ingredient, with an equal amount of surfactants and other non-water ingredients. While the manufacturer can employ a variety of different approaches, one example is to double the amount of each of the non-water ingredients and remove an equal amount of water. By so doing the manufacturer could make a composition which could produce the same wash liquor from a 1.5-fluid ounce dosage of the 2× CLLD as that obtained from a 3-fluid ounce dosage of the 1× NCLLD. Accordingly, if the performance profile of the 1× NCLLD had been effectively optimized, then the performance profile of the 2× CLLD can be expected to be similarly optimized. This will be true provided that the amount of water remaining in the 2× CLLD is sufficient to produce a readily dilutable liquid composition. By a similar procedure one might arrive at a 3×, 4×, 5× or 6× UCLLD starting from a 1× NCLLD provided that the amount of water remaining is sufficient to produce a readily dilutable liquid composition. Such products would have a 1-fluid ounce, ¾-fluid ounce, ⅗-fluid ounce, and ½-fluid ounce recommended dosage, respectively, to produce the wash liquor obtained from 3-fluid ounces of the 1× NCLLD.

Without being bound by theory, if no other limitations apply, the process of producing progressively more concentrated UCLLDs will be limited by the amount of water and water-miscible solvents in the original 1× NCLLD. For example, if the original 1× NCLLD contained 80% by weight of water, then this process could produce a 5× UCLLD if all 80% of the water were removed and replaced with non-water ingredients. However, a 6× or higher concentration UCLLD could not be conceivably produced by this same method, since the amount of water needed to be removed to produce a composition having such a concentration is not available in the 1× NCLLD.

Those skilled in the art of liquid laundry detergent formulation will recognize that other limitations can intervene before approaching the point at which all water has been eliminated. Liquid surfactant compositions do not simply remain as low viscosity, readily dilutable liquids as the water is progressively removed. Instead, at a certain point, they begin to separate into multiple phases, including highly viscous liquid crystalline phases (gel formation). These viscous liquid crystalline phases are not readily dispensed from liquid containers nor do they readily dissolve to form dilute solutions when mixed with water, particularly when mixed with cold water. The formation of these viscous liquid crystalline phases sharply limits the technology of producing readily diluted, flowable aqueous liquid detergent compositions as the content of water and water-miscible solvents decreases below 50%.

It has now been discovered that certain solvents of limited water solubility or specific electrolytes can overcome the issues associated with the formation of viscous liquid crystalline phases as water and water-miscible solvents are reduced in liquid laundry detergent compositions. In some cases, benzyl alcohol, dipropylene glycol n-butyl ether, and soluble magnesium salts can improve cool water dispersion better at lower levels than certain hydrotropes and monovalent electrolytes. Cool water dispersion can affect the utility of an UCLLD as water and water-miscible solvents are decreased.

In some cases, a composition provided herein (e.g., 3×+ UCLLD) can contain a nonionic surfactant from about 25% to about 60% by weight (e.g., 25%, 27%, 30%, 32%, 33%, 35%, 37%, 40%, 41%, 42%, 44%, 46%, 50%, 52%, 55%, 56%, 57%, and 60%) of the total composition. Non-limiting examples of a nonionic surfactant include fatty monoglyceride ethoxylates; block copolymers; ethoxylated amines; alkyl amine oxides; mono or poly saccharide alkyl ethers; propoxylated and ethoxylated fatty alcohols, fatty acids, and alkyl phenols; ether terminated ethoxylates of fatty acid and fatty alcohols; fatty acid glucamides; alkyl glucosides; alkyl polyglucosides; and mixtures thereof. Additional non-limiting examples of nonionic surfactants include various condensation products. For example, the condensation product from a mixture of about one mole of a fatty alcohol or fatty acid and about five to about 10 moles of ethylene oxide can be used, such products are referred to herein as fatty alcohol ethoxylates and fatty acid ethoxylates, respectively. The fatty alcohol or fatty acid can be saturated or unsaturated while the chain can be straight or branched. In addition, the chain can contain from ten to twenty carbon atoms. Other nonionic surfactants include, without limitation, those described in *McCutcheon's Emulsifiers and Detergents,* 1999 North American Edition.

In some aspects, a composition provided herein (e.g., 3×+ UCLLD) can include from about 5 to about 30% by weight (e.g., 5%, 6%, 12%, 12%, 15%, 17%, 18%, 19%, 20%, 22%, 24%, 25%, 26%, 27%, and 30%) of an anionic surfactant. Non-limiting examples of anionic surfactants include alkylbenzene sulfonates; alkyl ether sulfates; alkyl sulfates; alkyl and alkenyl ester sulfonates; alkyl and alkenyl sulfonates; isethionates; taurates; or mixture thereof. Any soluble alkali metal or ammonium salt of an anionic surfactant can be used, such as magnesium, sodium, alkanolamine (e.g., triethanolamine), and mixtures thereof. Non-limiting examples of alkylbenzene sulfonates include magnesium alkylbenzene sulfonate; sodium alkylbenzene sulfonate; triethanolamine alkylbenzene sulfonate; alkanolamine alkylbenzene sulfonate; or mixtures thereof. Non-limiting examples of alkyl ether sulfates include magnesium alkyl ether sulfate; sodium alkyl ether sulfate; triethanolamine alkyl ether sulfate; alkanolamine alkyl ether sulfate; or mixtures thereof.

In some cases, a composition provided herein (e.g., 3×+ UCLLD) can include from about 0.5% to about 18% by weight (e.g., 0.5%, 1%, 1.25%, 2%, 2.4%, 3%, 4%, 5%, 6%, 7%, 8%, 10%, 12%, 14%, 16% and 18%) of a cold water dispersion aid. Non-limiting examples of cold water dispersion aids include soluble alkali, alkaline earth, and divalent metal salts (e.g., $Zn^{2+}$); polyethylene glycol; poly-glycols; mono or polyhydric alcohols; water-miscible glycols; glycol ethers; hydrotropes; solvents of limited water solubility including without limitation benzyl alcohol; dipropylene glycol n-butyl ether; dipropylene glycol n-propyl ether; phenoxyethanol; or mixtures thereof. In some cases, a cold water dispersion aid can be a soluble magnesium salt. Any suitable water-soluble magnesium salt, including those of organic acids, may be used in the compositions herein. Examples of soluble magnesium salts include, without limitation, magnesium chloride, and magnesium sulfate heptahydrate. Insoluble magnesium ion sources such as magnesium oxide and magnesium hydroxide may be used provided they are solubilized by reaction with alkylbenzene sulfonic acid or another acidic compound. In some cases, 2% by weight of magnesium sulfate heptahydrate can be used in the composition.

Water can also be included in the compositions provided herein (e.g., 3×+ UCLLD). The amount of water used in the composition can vary depending on the distribution of the other components of the composition. In some cases, water can be added to the composition to bring the total composition to 100% by weight. For example, a composition provided herein (e.g., 3×+ UCLLD) can contain from about 0 to about 60% by weight (e.g., 0%, 2%, 5%, 10%, 12%, 14%, 17%, 20%, 22%, 24%, 27%, 30%, 31%, 32%, 36%, 38%, 40%, 42%, 47%, 50%, 51%, 54%, 56%, 59% and 60%) of water. In some cases, some or all of the water can be replaced with one or more of a monohydric alcohol, polyhydric alcohol, water-miscible solvent, or hydrotrope.

In some cases, a composition provided herein (e.g., 3×+ UCLLD) can contain additional components including, without limitation, a buffering agent, a detergent enzyme, an antiredeposition agent, a fragrance, a colorant, a fluorescent whitening agent, a corrosion inhibitor, an opacifier, an oxygen bleach, a fabric softening agent, a chlorine scavenger, a dye transfer inhibitor, a malodor control agent, a suds control agent, a chelating agent, adjuvant, and the like.

In some cases, a composition provided herein (e.g., 3×+ UCLLD) comprises less than about 1% by weight of a $C_{10-22}$ fatty acid.

In some cases, a composition provided herein (e.g., 3×+ UCLLD) can include from about 25 to about 60% by weight of a nonionic surfactant; from about 5 to about 30% by weight of an anionic surfactant; from about 0.5% to about 18% by weight of a cold water dispersion aid; and from about 0 to about 60% by weight water. An example of an ultra concentrated liquid laundry detergent composition can include from about 25 to about 60% by weight of a nonionic surfactant; from about 5 to about 30% by weight of an alkylbenzene sulfonate; from about 2 to about 12% by weight of propylene glycol; and from about 0.5% to about 6% by weight of magnesium sulfate heptahydrate. In some cases, a composition provided herein (e.g., 3×+ UCLLD) can include about 30 to about 45% by weight of an ethoxylate of a fatty alcohol; about 10 to about 25% by weight of a triethanolamine alkylbenzene sulfonic acid; about 2.5 to about 10% by weight of propylene glycol; about 1 to about 3% by weight of magnesium sulfate heptahydrate; and about 0.1 to about 0.5% by weight of a stilbene fluorescent whitening agent. In another aspect, an ultra concentrated liquid laundry detergent composition can include about 41% by weight of an ethoxylate of a fatty alcohol; about 19% by weight of a triethanolamine alkylbenzene sulfonic acid; about 7% by weight of propylene glycol; about 2% by weight of magnesium sulfate heptahydrate; and about 0.3% by weight of a stilbene fluorescent whitening agent.

A 3×+ UCLLD provided herein can be a 3×, 3.5×, 4×, 4.5×, 5×, 5.5×, 6× or 7× UCLLD. For example, an UCLLD can be formulated to be used at a dosage that is about ⅓, 2/7, ¼, 2/9, ⅕, 2/11, ⅙ or 1/7 the dose used for a 1× NCLLD.

The compositions described herein (e.g., a 3×+ UCLLD) may be prepared by any method known to those of skill in the art. For example, a composition may be prepared in any convenient way, such as combining the separate components or by combining premixes of two or more of the separate components with the remaining components.

In general it is desirable to avoid the formation of highly viscous or semi-solid compositions during the preparation of an UCLLD. For example, to avoid the formation of a highly viscous or semi-solid composition, one or more of the components can be preheated prior to combination with the remaining components. In some cases, when using an anionic surfactant in the acidic form, such as an unneutralized alkylbenzenesulfonic acid, the sulfonic acid and neutralizing agent may be combined prior to combination with the remaining components to release the heat of their reaction. Without being bound by theory, such a step can avoid the formation of highly viscous or semi-solid compositions in subsequent steps.

In some cases the addition of water to a concentrated surfactant composition can cause the formation of a highly viscous or semi-solid composition. Accordingly, in some cases, any liquid, non-surfactant component such as triethanolamine, propylene glycol or benzyl alcohol, can be added prior to addition of the surfactant components. In addition, the amount of water added prior to the addition of the surfactant components can be limited. For example, a small amount of water may be added prior to the addition of the surfactants. In certain cases, a majority of the cold water dispersion aid can be incorporated into the final water addition as this can help to suppress the formation of highly viscous or semi-solid compositions without the addition of excess heat.

In one example, utilizing an alkylbenzenesulfonic acid which is to be neutralized with triethanolamine, a small amount of water, the triethanolamine neutralizing agent and propylene glycol can be added to a vessel and agitated to mix. The nonionic surfactant can then be added and mixed, followed by addition of the alkylbenzene sulfonic acid. Any additional cold water dispersion aid can be dissolved in the remaining water and the aqueous mixture gradually added to the surfactant composition with continuous agitation. Optional ingredients such as a fluorescent whitening agent, fragrance, buffering agent, and preservative can then be added. In some cases, a premix of the nonionic surfactant and anionic surfactant, prior to addition of the cold water dispersion aid and the minor ingredients, e.g. preservative, fragrance, colorant, optical brightener, buffering agents, etc, can be prepared and stored until needed.

In an example using a preneutralized anionic surfactant containing a percentage of water, the nonionic surfactant can be mixed with part or all of the cold water dispersion aid, such as alkylene glycol or polyalkylene glycol or benzyl alcohol, and heated. The preneutralized anionic surfactant can then be gradually added with continuous agitation. Any additional cold water dispersion aid can be dissolved in the remaining water and this solution added to the surfactant composition with continuous agitation. Optional ingredients such as a fluorescent whitening agent, fragrance, buffering agent, and preservative can then be added.

Without being bound by theory, during preparation of a composition as described herein, care must be taken to avoid encountering highly viscous phases at an early point in the preparation of the compositions, and the early introduction of the cold water dispersion aid(s) provides one means of doing so. Care must also be taken to avoid exposing divalent ions such as the magnesium ions of the cold water dispersion aid to conditions which would result in their precipitation. For example, addition of large amounts of soluble soap can precipitate the magnesium ions, or a pH greater than about 8.0 can precipitate magnesium hydroxide or hydrous magnesium oxide.

Also provided herein is a method of cleaning fabrics in an automatic washing machine using an UCLLD composition as described herein. In some cases, the fabrics can be cotton and/or cotton-polyester fabrics. The method can include dispensing an effective amount of the UCLLD composition into the machine. In some cases, the amount of UCLLD composition can range from about 0.1 ounces to about 2 ounces. In some cases, the amount of UCLLD composition can range from about 0.5 ounces to about 1 ounce (e.g., 0.5, 0.75, and 1 ounce).

The detergency of an UCLLD composition, as described herein, can be measured by tergotometer testing, as is known in the art.

This disclosure relates to UCLLDs having superior water dispersibility at low temperatures (e.g., from about 14° C. to about 19° C.) compared to other similarly concentrated detergents lacking a cold water dispersion aid. In one aspect, the liquid composition can dissolve in cool water ranging from about 14° C. to about 19° C. in less than about 5 minutes (e.g., 0.5, 1, 2, 2.5, 3, 3.5, and 4 minutes).

EXAMPLES

Example 1

Ultra Concentrated Liquid Laundry Detergent Composition

An ultra concentrated liquid laundry detergent composition was prepared by combining 41.0% by weight of a linear $C_{12-14}$ fatty alcohol 7 EO ethoxylate; 18.9% by weight of triethanolamine alkylbenzene sulfonate; 7.2% by weight of propylene glycol; 2.0% by weight of magnesium sulfate heptahydrate; 0.3% by weight of a stilbene fluorescent whitening agent; and a complementary amount of water to bring the total composition to 100%. Analogs of the above detergent were prepared with the addition of one or more of a fragrance, colorant or a compatible preservative. In the case of these analogs, the amount of water was adjusted accordingly.

Example 2

Ultra Concentrated Liquid Laundry Detergent Composition

An ultra concentrated liquid laundry detergent composition was prepared by combining 40.0% by weight of a linear $C_{12-14}$ fatty alcohol 7 EO ethoxylate; 10.0% by weight of triethanolamine alkylbenzene sulfonate; 5.7% by weight of propylene glycol; 2.0% by weight of magnesium sulfate heptahydrate; less than 1.0% by weight of a preservative; and a complementary amount of water to bring the total composition to 100%.

Example 3

Ultra Concentrated Liquid Laundry Detergent Composition

An ultra concentrated liquid laundry detergent composition was prepared by combining 35.1% by weight of a linear $C_{12-14}$ fatty alcohol 7 EO ethoxylate; 16.2% by weight of triethanolamine alkylbenzene sulfonate; 6.7% by weight of propylene glycol; 2.0% by weight of magnesium sulfate heptahydrate; 0.3% by weight of an optical brightener; less than 1.5% by weight of one or more of a fragrance, colorant, or preservative; and a complementary amount of water to bring the total composition to 100%.

Example 4

Ultra Concentrated Liquid Laundry Detergent Composition

An ultra concentrated liquid laundry detergent composition was prepared by combining 30.0% by weight of a linear $C_{12-14}$ fatty alcohol 7 EO ethoxylate; 25.3% by weight of triethanolamine alkylbenzene sulfonate; 5.8% by weight of propylene glycol; 2.0% by weight of magnesium sulfate heptahydrate; less than 1.0% by weight of a preservative; and a complementary amount of water to bring the total composition to 100%.

Example 5

Ultra Concentrated Liquid Laundry Detergent Composition

An ultra concentrated liquid laundry detergent composition was prepared by combining 42.0% by weight of a linear $C_{12-14}$ fatty alcohol 7 EO ethoxylate; 7.0% by weight of triethanolamine alkylbenzene sulfonate; 5.2% by weight of propylene glycol; 2.0% by weight of magnesium sulfate heptahydrate; less than 1% by weight of a preservative; and a complementary amount of water to bring the total composition to 100%.

Example 6

Ultra Concentrated Liquid Laundry Detergent Composition

An ultra concentrated liquid laundry detergent composition was prepared by combining 35.1% by weight of nonylphenol 9 EO ethoxylate; 16.2% by weight of triethanolamine alkylbenzene sulfonate; 6.7% by weight of propylene glycol; 2.0% by weight of magnesium sulfate heptahydrate; 0.3% by weight of an optical brightener; less than 1.0% by weight of a preservative; and a complementary amount of water to bring the total composition to 100%.

Example 7

Ultra Concentrated Liquid Laundry Detergent Composition

An ultra concentrated liquid laundry detergent composition was prepared by combining 17.6% by weight of nonylphenol 9 EO ethoxylate; 17.6% by weight of a linear $C_{12-14}$ fatty alcohol 7 EO ethoxylate; 15.8% by weight of triethanolamine alkylbenzene sulfonate; 6.7% by weight of propylene glycol; 2.0% by weight of magnesium sulfate heptahydrate; 0.3% by weight of an optical brightener; less than 1.0% by weight of a preservative; and a complementary amount of water to bring the total composition to 100%.

Example 8

Ultra Concentrated Liquid Laundry Detergent Composition

An ultra concentrated liquid laundry detergent composition was prepared by combining 35.1% by weight of polyethylene glycol 8 oleate; 16.2% by weight of triethanolamine alkylbenzene sulfonate; 6.7% by weight of propylene glycol; 2.0% by weight of magnesium sulfate heptahydrate; 0.3% by weight of an optical brightener; less than 1.0% by weight of a preservative; and a complementary amount of water to bring the total composition to 100%.

Example 9

Ultra Concentrated Liquid Laundry Detergent Composition

An ultra concentrated liquid laundry detergent composition was prepared by combining 17.6% by weight of polyethylene glycol 8 oleate; 17.6% by weight of a linear $C_{12-14}$ fatty alcohol 7 EO ethoxylate; 15.8% by weight of triethanolamine alkylbenzene sulfonate; 6.7% by weight of propylene glycol; 2.0% by weight of magnesium sulfate heptahydrate; 0.3% by weight of an optical brightener; less than 1.0% by weight of a preservative; and a complementary amount of water to bring the total composition to 100%.

Example 10

Ultra Concentrated Liquid Laundry Detergent Composition

An ultra concentrated liquid laundry detergent composition was prepared by combining 41.0% by weight of a linear $C_{12-14}$ fatty alcohol 7 EO ethoxylate; 18.9% by weight of triethanolamine alkylbenzene sulfonate; 3.2% by weight of propylene glycol; 5.0% by weight of benzyl alcohol; 0.4% by weight of an optical brightener; 0.4% by weight tetrasodium ethylenediaminetetraacetic acid; less than 1.5% by weight of one or more of a fragrance, colorant, or preservative; and a complementary amount of water to bring the total composition to 100%.

Example 11

Ultra Concentrated Liquid Laundry Detergent Composition

An ultra concentrated liquid laundry detergent composition was prepared by combining 35.1% by weight of a linear $C_{12-14}$ fatty alcohol 7 EO ethoxylate; 16.2% by weight of triethanolamine alkylbenzene sulfonate; 2.7% by weight of propylene glycol; 6.0% by weight of dipropylene glycol n-butyl ether; 0.4% by weight of an optical brightener; 0.4% by weight tetrasodium ethylenediaminetetraacetic acid; less than 1.5% by weight of one or more of a fragrance, colorant, or preservative; and a complementary amount of water to bring the total composition to 100%.

Example 12

Ultra Concentrated Liquid Laundry Detergent Composition

An ultra concentrated liquid laundry detergent composition was prepared by combining 35.1% by weight of a linear $C_{12-14}$ fatty alcohol 7 EO ethoxylate; 16.2% by weight of triethanolamine alkylbenzene sulfonate; 2.7% by weight of propylene glycol; 4.0% by weight of benzyl alcohol; 0.4% by weight of an optical brightener; 0.4% by weight tetrasodium ethylenediaminetetraacetic acid; less than 1.5% by weight of one or more of a fragrance, colorant, or preservative; and a complementary amount of water to bring the total composition to 100%.

Example 13

Ultra Concentrated Liquid Laundry Detergent Composition

An ultra concentrated liquid laundry detergent composition was prepared by combining 41.0% by weight of a linear $C_{12-14}$ fatty alcohol 7 EO ethoxylate; 18.9% by weight of triethanolamine alkylbenzene sulfonate; 7.2% by weight of propylene glycol; 10% by weight of dipropylene glycol n-propyl ether; 0.3% by weight of an optical brightener; less than 1.5% by weight of one or more of a fragrance, colorant, or preservative; and a complementary amount of water to bring the total composition to 100%.

Example 14

Ultra Concentrated Liquid Laundry Detergent Composition

An ultra concentrated liquid laundry detergent composition was prepared by combining 52.7% by weight of a linear $C_{12-14}$ fatty alcohol 7 EO ethoxylate; 24.3% by weight of triethanolamine alkylbenzene sulfonate; 4.1% by weight of propylene glycol; 12% by weight of benzyl alcohol; 0.5% by weight of an optical brightener; less than 1.5% by weight of one or more of a fragrance, colorant, or preservative; and a complementary amount of water to bring the total composition to 100%.

Example 15

Ultra Concentrated Liquid Laundry Detergent Composition

An ultra concentrated liquid laundry detergent composition was prepared by combining 49.7% by weight of a linear $C_{12-14}$ fatty alcohol 7 EO ethoxylate; 22.9% by weight of triethanolamine alkylbenzene sulfonate; 3.8% by weight of propylene glycol; 12% by weight of dipropylene glycol n-butyl ether; 0.5% by weight of an optical brightener; less than 1.5% by weight of one or more of a fragrance, colorant, or preservative; and a complementary amount of water to bring the total composition to 100%.

Example 16

Ultra Concentrated Liquid Laundry Detergent Composition

An ultra concentrated liquid laundry detergent composition was prepared by combining 41.0% by weight of a linear $C_{12-14}$ fatty alcohol 7 EO ethoxylate; 12.6% by weight of sodium laureth sulfate; 3.0% by weight of propylene glycol; 8% by weight of benzyl alcohol; 0.3% by weight of an optical brightener; and a complementary amount of water to bring the total composition to 100%.

Example 17

Ultra Concentrated Liquid Laundry Detergent Composition

An ultra concentrated liquid laundry detergent composition was prepared by combining 33.2% by weight of a linear $C_{12-14}$ fatty alcohol 7 EO ethoxylate; 10.1% by weight of sodium laureth sulfate; 0.9% by weight of lauric acid; 0.9% by weight of triethanolamine; 3.0% by weight of propylene glycol; 8% by weight of benzyl alcohol; 0.3% by weight of an optical brightener; and a complementary amount of water to bring the total composition to 100%.

Example 18

Cool Water Dispersion Test

The time needed to completely dissolve 1 gram of liquid laundry detergent in 200 mL of water at 16° C. was determined using various hydrotropes and electrolytes as dispersion aids in cool water temperatures. The liquid laundry detergent tested contained 41.0% by weight of a linear $C_{12-14}$ fatty alcohol 7 EO ethoxylate; 18.9% by weight of the triethanolamine salt of an alkylbenzene sulfonic acid; 7.2% by weight of propylene glycol; 0.3% by weight of a stilbene fluorescent whitening agent; a variable amount of hydrotropes and electrolytes; less than 1.5% by weight of one or more of a fragrance, colorant, or preservative; and a complementary amount of water to bring the total composition to 100%.

It was determined that divalent magnesium sulfate heptahydrate and magnesium chloride electrolytes improved cool water dispersion at lower concentrations compared to other hydrotropes and electrolytes tested (Table 1).

TABLE 1

| Percent by Weight Hydrotrope/Electrolyte | Time (sec) |
|---|---|
| 5% Sodium xylene sulfonate (40% aq) | 391 |
| 10% Sodium xylene sulfonate (40% aq) | 371 |
| 5% Glycerin | 447 |
| 11% Glycerin | 325 |
| 3.5% Sorbitol | 326 |
| 7% Sorbitol | 314 |
| 5% Diethylene glycol mono butyl ether | 284 |
| 10% Diethylene glycol mono butyl ether | 182 |
| 2% Ethanol (SDA 40 B) | 395 |
| 5% Ethanol (SDA 40 B) | 365 |
| 10% Ethanol (SDA 40 B) | 240 |
| 2% Benzyl alcohol | 261 |
| 4% Benzyl alcohol | 130 |
| 5% Benzyl alcohol | 65 |
| 5% Dipropylene glycol n-butyl ether | 207 |
| 8% Dipropylene glycol n-butyl ether | 40 |
| 5% Dipropylene glycol n-propyl ether | 221 |
| 10% Dipropylene glycol n-propyl ether | 79 |

TABLE 1-continued

| Percent by Weight Hydrotrope/Electrolyte | Time (sec) |
|---|---|
| 1% Magnesium chloride hexahydrate | 321 |
| 2% Magnesium chloride hexahydrate | 58 |
| 2% Magnesium sulfate heptahydrate | 51 |
| 2% Sodium chloride | 426 |

Example 19

Effect of Surfactant Concentration on Cool Water Dispersion

The time (in seconds) needed to completely dissolve 1 gram of liquid laundry detergent in 200 mL of water at 16° C. was determined using various amounts of surfactants, while keeping the ratio of anionic to nonionic surfactants constant (see Table 2). The liquid laundry detergent tested contained variable amounts of a triethanolamine salt of an alkylbenzene sulfonic acid and a linear $C_{12-14}$ fatty alcohol 7 EO ethoxylate; 7.2% by weight of propylene glycol; 0.3% by weight of a stilbene fluorescent whitening agent; a variable amount of magnesium sulfate heptahydrate; and a complementary amount of water to bring the total composition to 100%.

TABLE 2

| | 34.2% Surfactants Time (sec) | 51.3% Surfactants Time (sec) | 59.9% Surfactants Time (sec) | 68.4% Surfactants Time (sec) |
|---|---|---|---|---|
| 0% Magnesium sulfate heptahydrate | 36 | 994 | 511 | 457 |
| 2% Magnesium sulfate heptahydrate | | 22 | 56 | 152 |

Example 20

Effect of Nonionic to Anionic Surfactant Ratios on Cool Water Dispersion

The time (in seconds) needed to completely dissolve 1 gram of liquid laundry detergent in 200 mL of water at 16° C. was determined using various ratios of nonionic to anionic surfactants (see Table 3). The liquid laundry detergent tested contained variable amounts of a triethanolamine salt of an alkylbenzene sulfonic acid and a linear $C_{12-14}$ fatty alcohol 7 EO ethoxylate; 5% to 7% by weight of propylene glycol; 0.3% by weight of a stilbene fluorescent whitening agent; a variable amount of magnesium sulfate heptahydrate; and a complementary amount of water to bring the total composition to 100%.

TABLE 3

| | Weight Ratio of Nonionic to Anionic | | | | |
|---|---|---|---|---|---|
| Surfactant | 8:1 Time (sec) | 6:1 Time (sec) | 4:1 Time (sec) | 2.2:1 Time (sec) | 1.2:1 Time (sec) |
| 0% $MgSO_4$ | 2190 | 2067 | 1452 | 994 | 1048 |
| 2% $MgSO_4$ | 66 | 356 | 144 | 22 | 33 |

Example 21

Effect of Various Nonionic Surfactants on Cool Water Dispersion

The time (in seconds) needed to completely dissolve 1 gram of liquid laundry detergent in 200 mL of water at 16° C. was determined using various nonionic surfactants and mixtures thereof, while keeping the ratio of anionic to nonionic surfactants constant (see Table 4 and 5). The liquid laundry detergent tested contained variable amounts of nonionic surfactants; 16.2% by weight of the triethanolamine salt of an alkylbenzene sulfonic acid; 6.7% by weight of propylene glycol; 0.3% by weight of a stilbene fluorescent whitening agent; a variable amount of magnesium sulfate heptahydrate; and a complementary amount of water to bring the total composition to 100%.

TABLE 4

| | 35% Nonylphenol ethoxylate 0% Alcohol ethoxylate | 17.5% Nonylphenol ethoxylate 17.5% Alcohol ethoxylate | 0% Nonylphenol ethoxylate 35% Alcohol ethoxylate |
|---|---|---|---|
| 0% $MgSO_4$ | 888 | 1266 | 994 |
| 2% $MgSO_4$ | 47 | 32 | 22 |

TABLE 5

| | 35% PEG 8 Oleate 0% Alcohol ethoxylate | 17.5% PEG 8 Oleate 17.5% Alcohol ethoxylate | 0% PEG 8 Oleate 35% Alcohol ethoxylate |
|---|---|---|---|
| 0% MgSO4 | 157 | 832 | 994 |
| 2% MgSO4 | 60 | 32 | 22 |

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. An ultra concentrated liquid laundry detergent composition comprising:

(a) from about 35 to about 55% by weight of a nonionic surfactant;

(b) from about 15 to about 25% by weight of an anionic surfactant;

(c) from about 2 to about 18% by weight of a cold water dispersion aid; and (d) from about 0 to about 60% by weight water;

wherein said composition contains less than 1.5% by weight of one or more of a fragrance, colorant, or preservative, and does not have a viscous liquid crystalline phase.

2. The composition of claim 1, wherein said composition contains less than 1% by weight of a $C_{10-22}$ fatty acid.

3. The composition of claim 1, wherein said nonionic surfactant is selected from the group consisting of fatty alcohol ethoxylates; fatty acid ethoxylates; alkyl phenol ethoxylates; fatty monoglyceride ethoxylates; block copolymers; ethoxylated amines; alkyl amine oxides; mono or poly saccharide alkyl ethers; propoxylated and ethoxylated fatty alcohols; propoxylated and ethoxylated fatty acids; propoxylated and ethoxylated alkyl phenols; ether terminated ethoxylates of fatty acid and fatty alcohols; fatty acid glucamides; alkyl glucosides; alkyl polyglucosides; or mixtures thereof.

4. The composition of claim 3, wherein said fatty alcohol ethoxylate comprises the condensation product of about 5 to about 10 moles of ethylene oxide per mole of alcohol.

5. The composition of claim 1, wherein said anionic surfactant is selected from the group consisting of alkylbenzene sulfonates; alkyl ether sulfates; alkyl sulfates; alkyl and alkenyl ester sulfonates; alkyl and alkenyl sulfonates; isethionates; taurates; and mixtures thereof.

6. The composition of claim 5, wherein said alkyl ether sulfate salt is selected from the group consisting of magnesium alkyl ether sulfate; sodium alkyl ether sulfate; triethanolamine alkyl ether sulfate; alkanolamine alkyl ether sulfate; and mixtures thereof.

7. The composition of claim 5, wherein said alkylbenzene sulfonate is selected from the group consisting of magnesium alkylbenzene sulfonate; sodium alkylbenzene sulfonate; triethanolamine alkylbenzene sulfonate; alkanolamine alkylbenzene sulfonate; and mixtures thereof.

8. The composition of claim 7, wherein said alkanolamine alkylbenzene sulfonate is triethanolamine alkylbenzene sulfonate.

9. The composition of claim 1, wherein said cold water dispersion aid is selected from the group consisting of soluble alkali, alkaline earth, and divalent metal salts; polyethylene glycol; poly-glycols; mono or polyhydric alcohols; water-miscible glycols; glycol ethers; hydrotropes; solvents of limited water solubility including without limitation benzyl alcohol; dipropylene glycol n-butyl ether; dipropylene glycol n-propyl ether; phenoxyethanol; and mixtures thereof.

10. The composition of claim 1, wherein said composition comprises one or more of a buffering agent, a detergent enzyme, an antiredeposition agent, a fragrance, a colorant, a fluorescent whitening agent, a corrosion inhibitor, an opacifier, an oxygen bleach, a fabric softening agent, a chlorine scavenger, a dye transfer inhibitor, a malodor control agent, a suds control agent, a chelating agent and an adjuvant.

11. The composition of claim 1, wherein said composition comprises:

(a) from about 35 to about 55% by weight of a nonionic surfactant;

(b) from about 15 to about 25% by weight of an alkylbenzene sulfonate;

(c) from about 2 to about 12% by weight of propylene glycol; and (d) from about 0.5% to about 6% by weight of magnesium sulfate heptahydrate.

12. The composition of claim 1, wherein said composition comprises:

(a) from about 35 to about 45% by weight of an ethoxylate of a fatty alcohol;

(b) from about 15 to about 25% by weight of a triethanolamine alkylbenzene sulfonate;

(c) from about 2.5 to about 10% by weight of propylene glycol;

(d) from about 1 to about 3% by weight of magnesium sulfate heptahydrate; and (e) from about 0.1 to about 0.5% by weight of a stilbene fluorescent whitening agent.

13. The composition of claim 1, wherein said composition disperses in water from about 14° C. to about 19° C. in less than about 5 minutes.

14. The composition of claim 1, wherein said composition is a 3× ultra concentrated liquid laundry detergent.

15. The composition of claim 1, wherein said composition is a 4× ultra concentrated liquid laundry detergent.

16. The composition of claim 1, wherein said composition is a 5× ultra concentrated liquid laundry detergent.

17. The composition of claim 1, wherein said composition is a 6× ultra concentrated liquid laundry detergent.

18. The composition of claim 1, wherein said composition is a 7× or higher ultra concentrated liquid laundry detergent.

19. A method of cleaning fabrics in an automatic washing machine, said method comprising dispensing an effective amount of an ultra concentrated liquid laundry detergent composition into said machine, said composition comprising:

(a) from about 35 to about 55% by weight of a nonionic surfactant;

(b) from about 15 to about 25% by weight of an anionic surfactant;

(c) from about 2 to about 18% by weight of a cold water dispersion aid; and (d) from about 0 to about 60% by weight water;

wherein said composition contains less than 1.5% by weight of one or more of a fragrance, colorant, or preservative, and does not have a viscous liquid crystalline phase.

20. The method of claim 19, wherein said effective amount of said liquid composition ranges from about 0.1 fluid ounces per wash load to about 2 ounces per wash load.

21. The method of claim 19, wherein said effective amount of said liquid composition ranges from about 0.5 fluid ounces per wash load to about 1 ounce per wash load.

22. The method of claim 19, wherein said liquid composition disperses in water from about 14° C. to about 19° C. in less than about 5 minutes.

* * * * *